US006223792B1

(12) United States Patent
Slagle

(10) Patent No.: US 6,223,792 B1
(45) Date of Patent: May 1, 2001

(54) FUNNEL CAP DEVICE FOR A FLUID CONTAINER

(76) Inventor: Ray N. Slagle, 13651 Laurinda Way, Santa Ana, CA (US) 92705

( * ) Notice: Subject to any disclaimer, the term of this patent is extended or adjusted under 35 U.S.C. 154(b) by 0 days.

(21) Appl. No.: 09/321,694

(22) Filed: May 28, 1999

(51) Int. Cl.[7] ..... B65B 39/00; B67C 11/04

(52) U.S. Cl. ..... 141/331; 141/311 R; 141/313; 141/338; 141/340; 141/344; 141/345; 222/206; 222/212; 222/215; 222/460; 222/461; 222/525

(58) Field of Search ..... 141/311 R, 313, 141/331, 332, 335, 338, 343, 344, 345, 340; 222/460, 461, 523, 525, 106, 107, 206, 212, 215

(56) References Cited

U.S. PATENT DOCUMENTS

| | | | | |
|---|---|---|---|---|
| 129,024 | | 7/1872 | George . | |
| 589,659 | * | 9/1897 | Krack | 141/338 |
| 782,736 | | 2/1905 | Epperson . | |
| 947,917 | * | 2/1910 | Kollenberg | 141/335 |
| 1,061,888 | * | 5/1913 | Von Der Crone | 141/335 |
| 1,104,354 | * | 7/1914 | Gentle | 141/335 |
| 1,596,974 | * | 8/1926 | Holmes | 141/335 |
| 4,331,189 | * | 5/1982 | Joyner | 141/343 |
| 5,305,910 | | 4/1994 | Pollacco . | |

* cited by examiner

*Primary Examiner*—Steven O. Douglas
*Assistant Examiner*—Timothy L. Maust
(74) *Attorney, Agent, or Firm*—Lyon & Lyon LLP

(57) ABSTRACT

A funnel cap device for a fluid container includes a funnel-shaped member having a passage therethrough extending between a wide end and a narrow end thereof, and a cap member attached to the funnel-shaped member for selectively opening and closing the narrow end of the passage. A hub portion extends from the narrow end of the funnel-shaped member, the cap member being slidable on the hub portion between open and closed positions. The cap member and hub portion include a cooperating aperture and seal tab which mutually engage in the closed position to prevent fluid flow. The funnel cap device is attachable to a fluid container having a spout on one end. The funnel-shaped member includes an intermediate portion having a thread pattern on an inner surface for engaging similar threads on the spout in an upright orientation where the funnel-shaped member engages the neck of the container. The hub portion has a cross-section smaller than a cross-section of the spout, whereby the hub portion may be inserted into the spout with the wide end of the funnel-shaped member oriented away from the container to facilitate filling of the container.

18 Claims, 5 Drawing Sheets

FUNNEL CAP DEVICE FOR A FLUID CONTAINER

FIELD OF THE INVENTION

The present invention relates generally to fluid containers, and more particularly to a closure device for a fluid container, such as a sports bottle, that also facilitates filling of the fluid container.

BACKGROUND

A variety of fluid containers are known for carrying small amounts of liquid, such as water, for personal use. Such containers generally have a tapered spout on one end which facilitates drinking and a cap that is attachable to the spout to prevent fluid from leaking when the contents of the container are being stored. For example, the cap may be a simple threaded cap that is manually screwed onto similar threads on the spout. Thus, when fluid is introduced into or removed from the container, the cap is removed, the fluid is poured into or out of the spout and then the cap is screwed back on to close the container.

In particular, "sports bottles" have become increasingly popular which have of a pull cap device attached to the spout of a bottle or other container. The pull cap device has an annular cap member which is generally slidable over a collar having a passage therethrough. In a closed position, a seal tab on the collar engages a narrow portion of the cap member to provide a fluid-tight seal and prevent fluid from passing through the collar. The pull cap may be slid along the collar to an open position such that the seal tab is disengaged from the narrow portion and fluid may pass through the passage. Thus, when the pull cap device is attached to a bottle, e.g., by threading the collar onto a spout of the bottle, the cap member may be easily opened and closed to allow removal of fluid from the container without removing the pull cap device from the bottle.

To fill a sports bottle, e.g., after the contents have been drunk or otherwise emptied, the pull cap device is unscrewed from the spout, and fluid may be poured directly into the spout of the bottle. Because the spouts of such bottles are relatively narrow, however, pouring fluid into the container may not be as convenient as desired. Fluid may be spilled over the spout, possibly wasting the fluid and/or creating a mess.

Accordingly, it is believed that a fluid container which may be more conveniently filled and/or which overcomes the problems of previous containers may be useful.

SUMMARY OF THE INVENTION

The present invention is directed to a funnel cap device for a fluid container and to a fluid container incorporating such a funnel cap device. In accordance with one aspect of the present invention, a funnel cap device is provided that includes a generally funnel-shaped member having a passage therethrough extending between a wide end and a narrow end thereof, and a cap member attached to the funnel-shaped member for selectively opening and closing the narrow end of the passage. The narrow end of the funnel-shaped member may have a connector thereon for attaching to a spout of a fluid container, such as a thread pattern on an inner surface thereof.

In a preferred form, a hub portion extends from the narrow end of the funnel-shaped member, the cap member being slidable on the hub portion between open and closed positions, such that fluid may pass through the passage in the open position. In addition, the cap member may include an aperture and the hub portion may include a seal tab, the aperture being substantially engaged by the seal tab in the closed position for preventing fluid from passing through the passage.

The cap member and hub portion may also include a cooperating track and tab for limiting movement of the cap member between the open and closed positions. For example, the hub portion may have a recessed region extending along the outer surface thereof, e.g. about its circumference, and the cap member may include an inwardly directed tab, e.g. having an annular shape, that may be slidably received within the recessed region. In addition, an annular ridge may be provided in the recessed region for preventing the cap member from inadvertently moving from the open or closed positions. Thus, the cap member may be directed to the open position to allow fluid flow through the passage, and then the cap member may be directed to the closed position, the seal tab engaging the aperture, to prevent fluid flow.

In accordance with another aspect of the present invention, a refillable fluid container is provided that includes a container having a neck and a spout on one end thereof, a generally funnel-shaped member having a passage extending therethrough between a wide end and a narrow end thereof, the narrow end being attachable to the spout, and a closable sealing mechanism on the narrow end of the funnel-shaped member. The funnel-shaped member preferably includes a hub portion extending from the narrow end thereof, and the sealing mechanism preferably is an annular shaped cap member slidable on the hub portion between open and closed positions, as described above.

Preferably, the funnel-shaped member includes an intermediate portion adjacent the hub portion, the intermediate portion having a thread pattern on an inner surface thereof for attaching the funnel-shaped member to the spout in an upright orientation. In the upright orientation, the wide end of the funnel-shaped member is directed over the spout of the container until the spout engages the threads within the intermediate portion, whereupon the funnel-shaped member is rotated to screw it onto the container. In a preferred form, the funnel-shaped member has a shape similar to the neck of the container such that the funnel-shaped member conforms substantially to the shape of the container and occupies little or substantially no extra space.

In addition, the hub portion has a configuration for coupling the hub portion within a spout of the container in an inverted or filling orientation to facilitate filling of the container. For example, in a preferred form, the hub portion may have a cross-section smaller than a cross-section of the spout, whereby the hub portion may be inserted into the spout with the wide end of the funnel-shaped member oriented away from the container. The hub portion may include a plurality of ribs extending radially outward therefrom for engaging an inner surface of the spout. The ribs may include notches therein for receiving the spout and providing air passages between the ribs.

Thus, in the inverted orientation, the wide end of the funnel-shaped member is oriented upward such that fluid may be directed into the wide end, through the passage in the funnel-shaped member, through the spout and into the container. The relatively wide opening of the wide end facilitates filling of the container with substantially less spilling of fluid, reducing the waste and mess that may be associated with filling a container through a small spout.

Other objects and features of the present invention will become apparent from consideration of the following description taken in conjunction with the accompanying drawings.

DETAILED DESCRIPTION OF THE PREFERRED EMBODIMENTS

Figure 1:
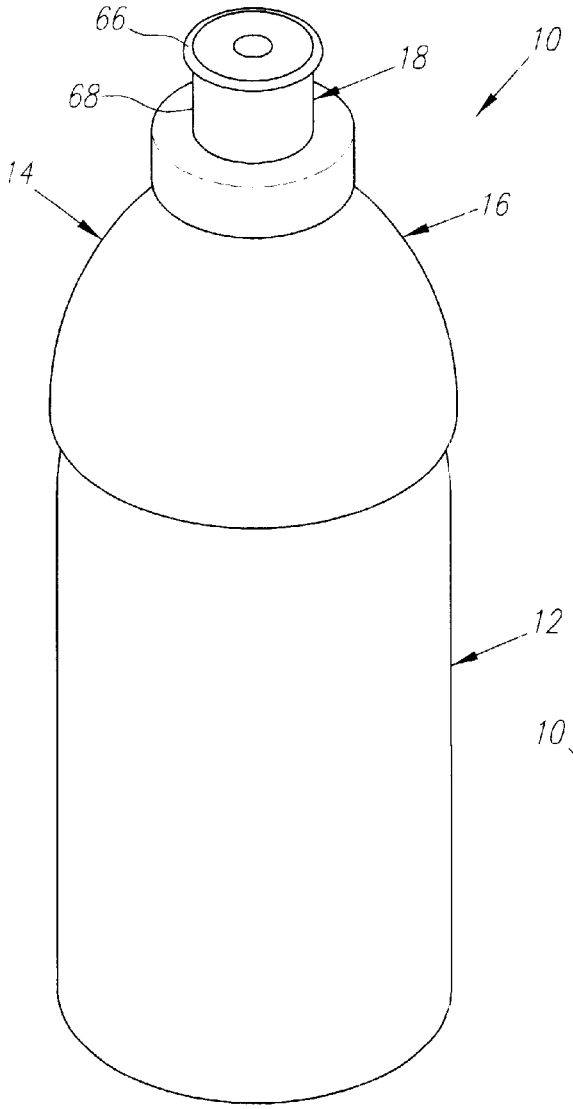
FIG. 1 is a perspective view of a fluid container with a funnel cap device attached in an upright orientation, in accordance with present invention.

Turning now to the drawings, FIGS. 1–5B show a sports bottle 10 including a bottle 12 and a funnel cap device 14, in accordance with the present invention. The bottle 12 may be a conventional bottle or other substantially enclosed fluid container formed from known materials, such as plastic or glass. The bottle 12 generally has a neck 20 on one end that terminates in a spout 22, the spout 22 preferably having a thread pattern 24 formed thereon.

Figure 4A:
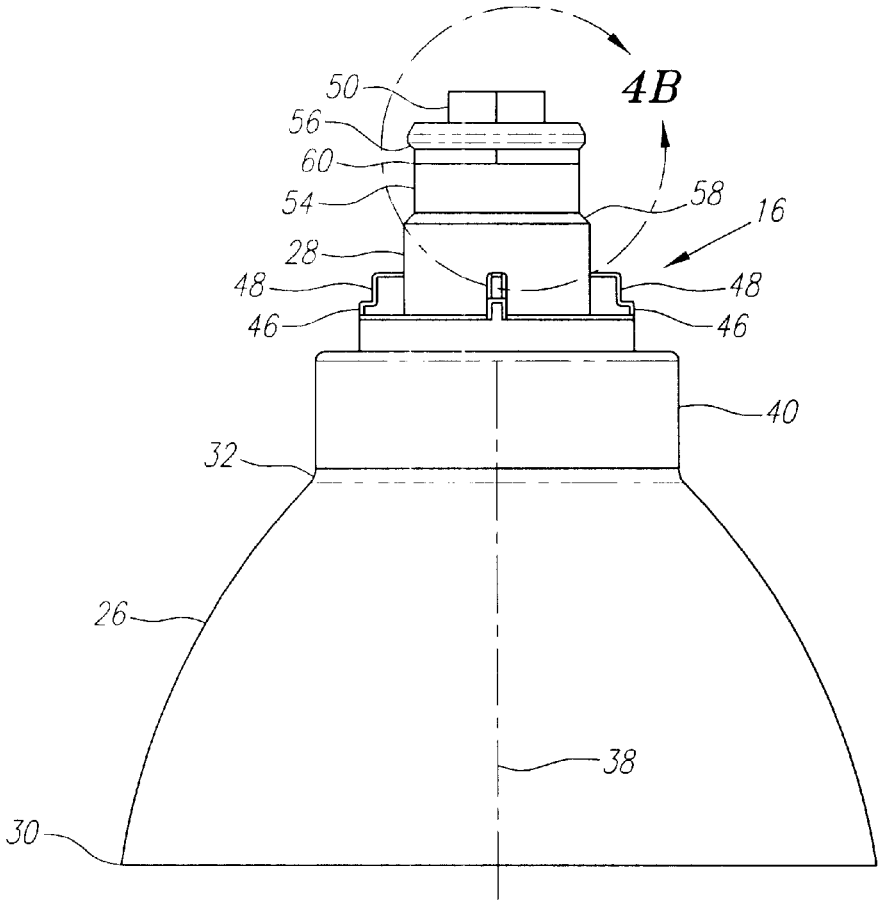
FIG. 4A is a side view of a funnel-shaped member of the funnel cap device of FIG. 1.

The funnel cap device 14 generally includes two parts, namely a generally funnel-shaped member 16 and a cap member 18, which may be formed from a variety of conventional materials, such as plastic, glass or metal. As best seen in FIG. 4A, the funnel-shaped member 16 includes a generally frusto-conical portion 26 having a wide end 30 and a narrow end 32, and a hub portion 28 extending from the narrow end 32. The generally frusto-conical portion 28 may have a true conical shape, or may have a tapered or curved shape, and the term "frusto-conical" is intended to include any such variations. In a preferred form, the frusto-conical portion 28 has a shape that corresponds substantially to the shape of the neck of the bottle or other container to which the funnel cap device 14 is attached.

Figure 3A:
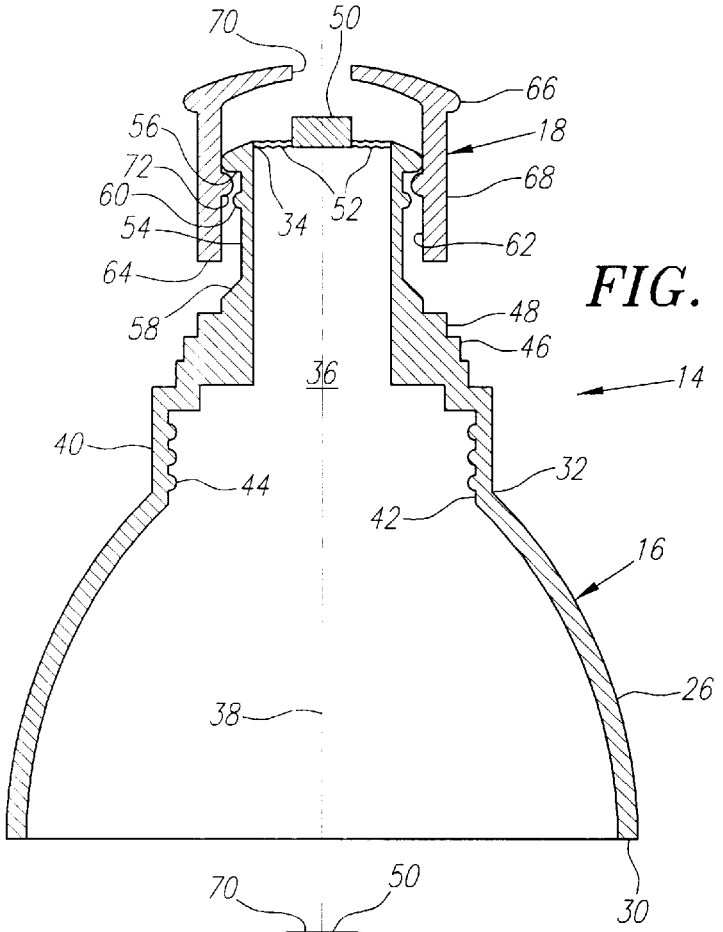
FIGS. 3A and 3B are cross-sectional views of the funnel cap device of FIG. 1, showing the funnel cap device in open and closed positions, respectively.
Figure 3B:
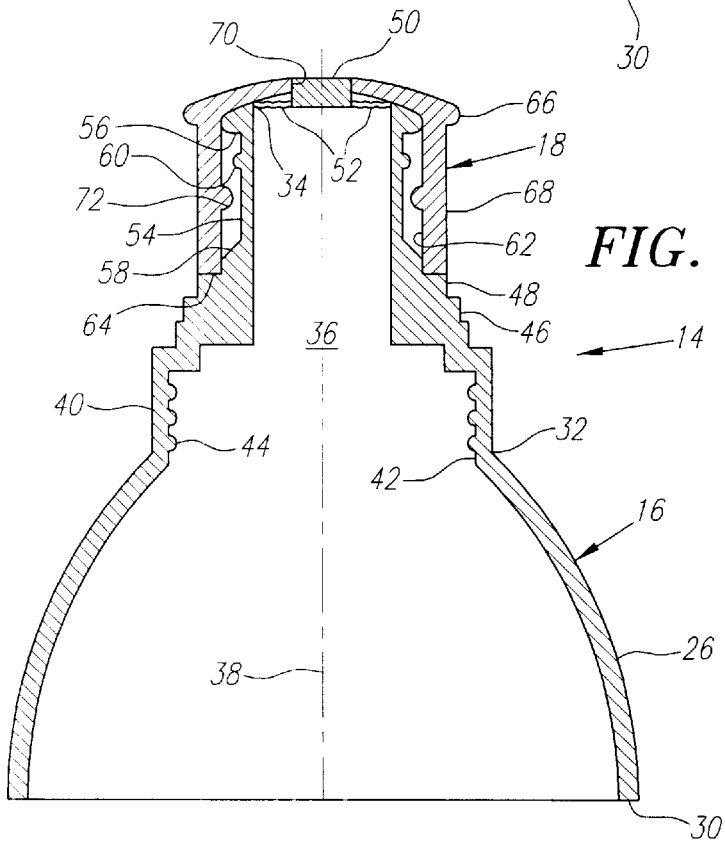

Turning to FIGS. 3A and 3B, a passage 36 extends along axis 38 between the wide end 30, the narrow end 32, and through the hub portion 28 to an opening 34. A seal tab 50, preferably having a disk shape, is provided in the opening 34 supported, for example, by a plurality of arms 52 (shown in phantom). The funnel-shaped member 16 also preferably includes an intermediate collar portion 40 which has an inner surface 42 with a thread pattern 44 thereon that corresponds substantially to the thread pattern 24 of the spout 22.

Returning to FIG. 4A, the hub portion 28 preferably includes a plurality of radially outwardly extending ribs 46 that are arranged substantially parallel to the axis 38 around the base of the hub portion 28. The ribs 46 each have a notch 48 therein, which facilitate engagement between the ribs 46 and the interior of the spout 22, as explained further below (see FIG. 5A).

Figure 4B:
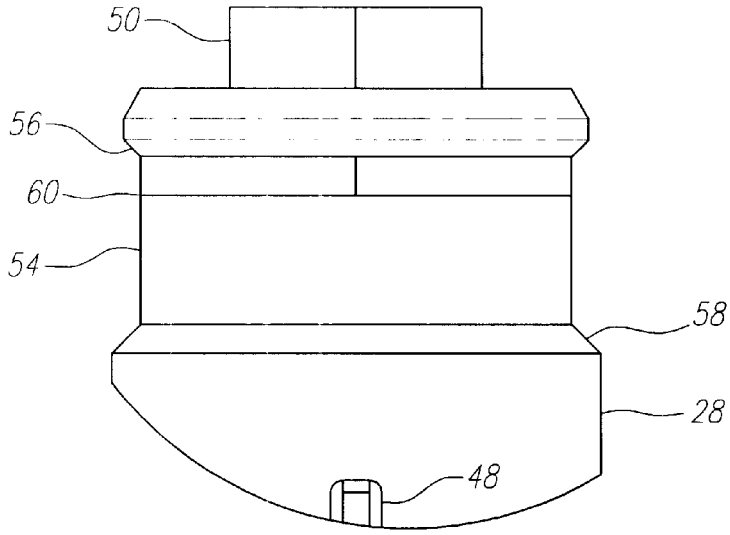
FIG. 4B is a detail of the hub portion of the funnel-shaped member of FIG. 4A.

With particular reference to FIG. 4B, the hub portion 28 also includes a recessed region 54 that extends around the circumference of the hub portion 28, thereby defining an upper shoulder 56 and a lower shoulder 58. The recessed region 54 defines a track for guiding the cap member 18 between open and closed positions, as explained further below. An annular ridge 60 may be provided that extends outward from the recessed region 54 to facilitate holding the cap member 18 at one or more positions, for example, in the open position.

Returning to FIGS. 1, 3A and 3B, the cap member 18 has an elongate annular portion 68 and an upper cap portion 66. The cap member 18 thereby defines a passage 62 that extends between an open lower end 64 and an aperture 70 in the upper cap portion 66. Preferably, the aperture 70 has a cross-section that corresponds substantially to the cross-section of the seal tab 50, e.g., a circular shape of similar diameter to the disk shape of the seal tab 50. The cap member 18 also includes an annular tab 72 that extends inward into the passage 62 from an inner surface thereof.

To assemble the funnel cap device 14, the open lower end 64 of the cap member 18 is advanced over the end of the hub portion 28. The materials of the funnel-shaped member 16 and/or the cap member 18 are sufficiently flexible to allow the annular tab 72 on the cap member 18 to be forced over the end of the hub portion 16, past the upper shoulder 56 and into the recessed region 54 without damaging either part. Once the annular tab 72 has been received within the recessed region 54, the axial movement of the cap member is substantially limited by the upper and lower shoulders 56, 58 between open and closed positions.

The funnel cap device 14 may then be attached to the spout of the bottle 12 in an upright orientation, for example, by directing the wide end 30 of the funnel-shaped member 16 over the neck 20 of the container 12 until the spout 22 is received in the intermediate portion 40. The funnel cap member 16 may then be rotated to thread the spout 22 to the thread pattern 44 within the intermediate portion 40, thereby securing the funnel cap member 16 to the bottle 12, and preferably providing a fluid-tight seal therebetween.

Turning to FIG. 3B, the cap member 18 is shown in its closed position. In the closed position, the seal tab 50 substantially engages the aperture 70 in the upper cap portion 66, thereby providing a fluid-tight seal therebetween. In addition, the annular tab 72 may engage the lower shoulder 56 and/or the open end 64 of the cap member 18 may engage the ribs 46 to prevent further axial movement of the cap member 18 towards the frusto-conical portion 26.

When it is desired to open the bottle 10, e.g., to drink the contents, the cap member 18 may be pulled axially away from the funnel-shaped member 16 until the seal tab 50 is disengaged from the aperture 70, as shown in FIG. 3A. Preferably, the cap member 18 is directed axially until the annular tab 72 passes over the annular ridge 60 and/or abuts the upper shoulder 56. The annular ridge 60, which may have a height of only about 0.005 inch, provides a slight resistance for the annular tab 72 passing over it, and may also create a distinctive sound to indicate that the cap member 18 has been directed to the open position. The annular ridge 60 may also prevent the cap member 18 from inadvertently sliding back down, to prevent the seal tab 50 from partially blocking or fully engaging the aperture 70 and affecting flow of fluid through the hub portion 28. Thus, in the open position, fluid may freely pass from the interior of the bottle 12 (not shown in FIG. 3A) through the hub portion 28 of the funnel cap member 18 and out the aperture 70. After removing fluid from the bottle 12, the cap member 18 may be directed to the closed position with sufficient force to cause the annular tab 72 to pass over the annular ridge 60.

Figure 2:
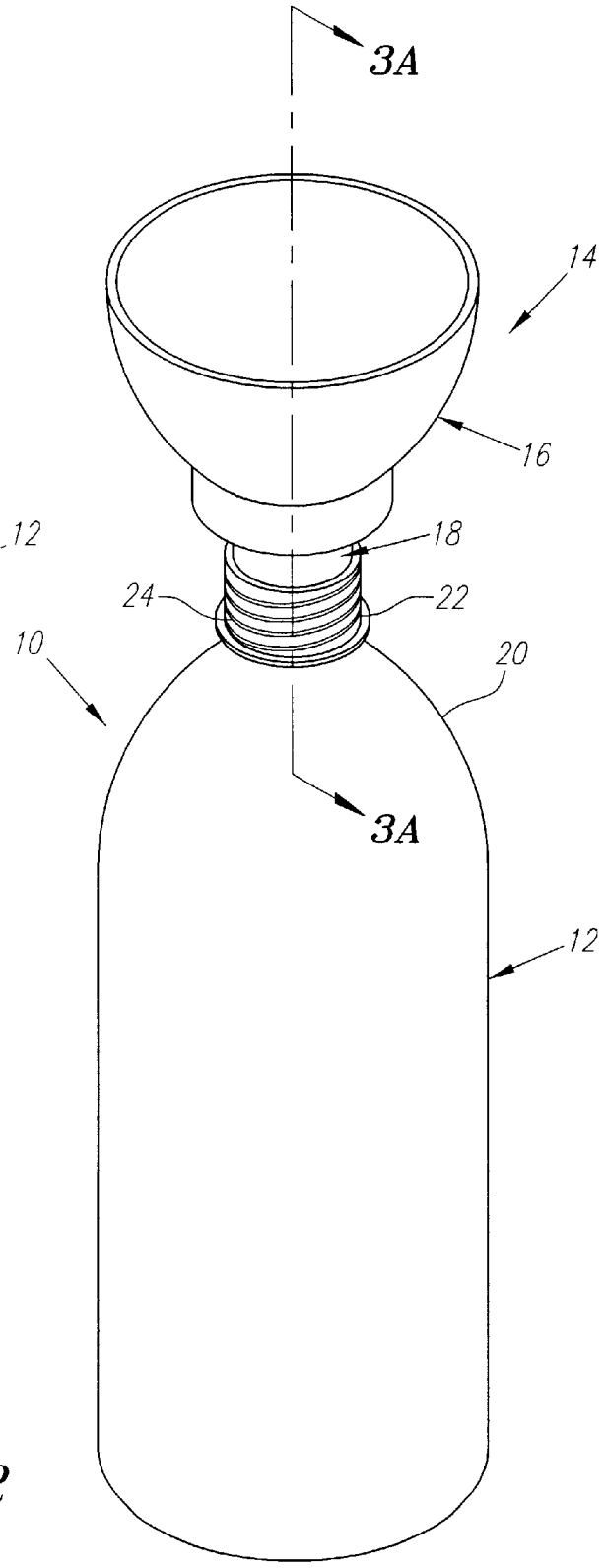
FIG. 2 is a perspective view of the fluid container of FIG. 1, with the funnel cap device attached to the container in an inverted orientation to facilitate filling of the container.
Figure 5A:
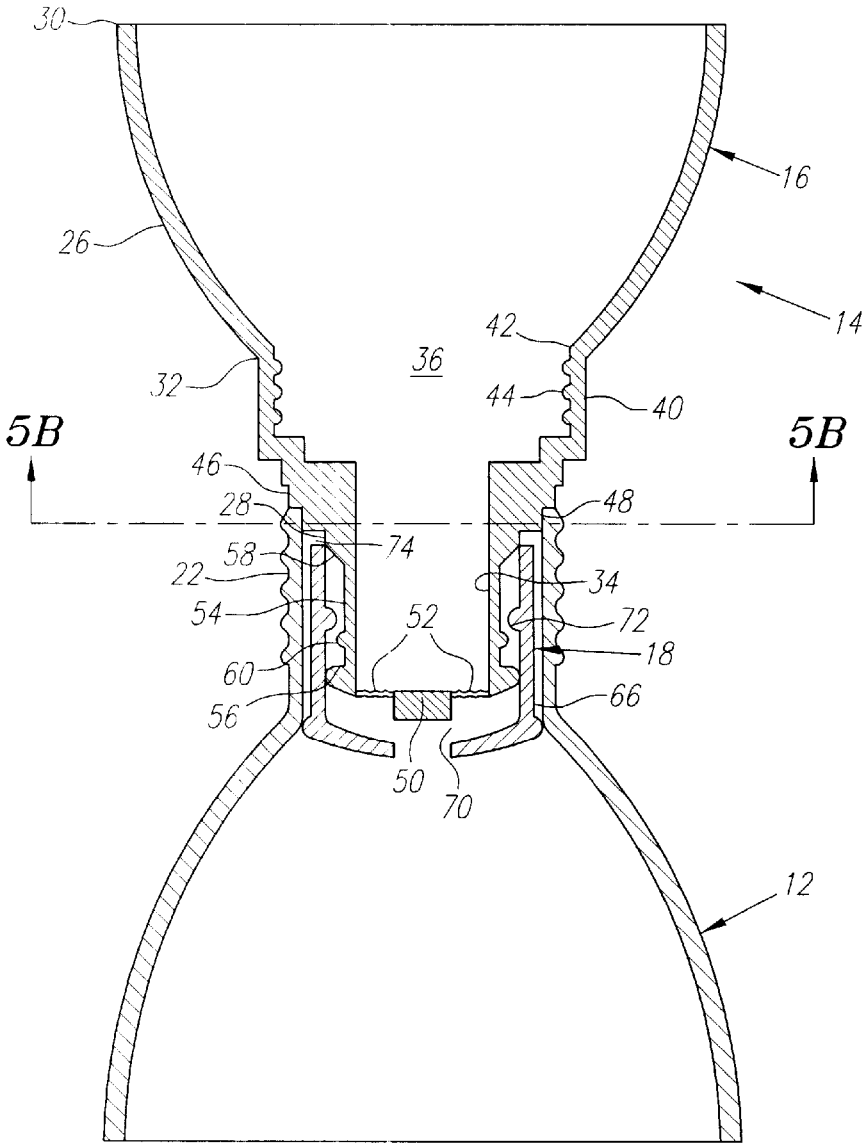
FIG. 5A is a cross-sectional view of the fluid container and funnel cap device of FIG. 2, taken along line A—A.

As shown in FIGS. 2 and 5A, once the contents of the bottle 12 have been emptied or whenever it is desired to introduce fluid into the bottle 12, the funnel cap device 14 may be unscrewed from the bottle 12, inverted, and attached to the spout 22 in an inverted or filling orientation. The hub portion 28, with the cap member 18 in its open position, is introduced into the spout 22 until the spout 22 engages the notches 48 in the axial ribs 46. Preferably, the notches 48 and ribs 46 define a diameter corresponding substantially to the interior of the spout 22 to substantially secure the funnel cap device 14 to the bottle 12. The upper cap portion 66 of the cap member 18 may slidably engage the interior of the spout 22 to provide lateral support, and the annular ridge 60 may prevent the cap member 18 from sliding and partially or completely closing. Fluid may then be introduced into the wide end 30 of the funnel-shaped member 16, which will pass through the passage 36 into the interior of the bottle 12.

Figure 5B:
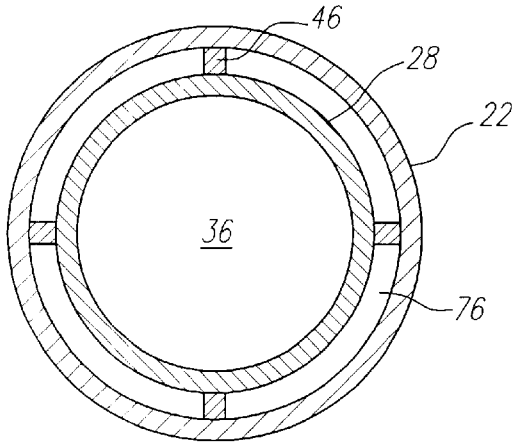
FIG. 5B is a cross-sectional view of the fluid container and funnel cap device of FIG. 5A, taken along line B—B.

Preferably, the ribs 48 prevent the spout 22 from abutting the intermediate portion 40, and provide air passages 76 about the spout 22 between adjacent ribs 46 (see FIG. 5B). These air passages 76 communicate with the annular space 74 between the spout 22 and the hub portion 28, thereby communicating with the interior of the bottle 12. Notches (not shown) may be provided on the outer circumference of the upper cap portion 66 of the cap member 18 to prevent a fluid-tight seal from being formed between the spout 22 and the upper cap portion 66. Thus, when fluid is introduced into the bottle 12, air within the bottle 12 may freely escape through the air passages 76 without interfering with fluid flow into the bottle 12 through the passage 36.

Once the bottle 12 is filled, the hub portion 38 may be removed from the spout 22, the funnel cap device 14 inverted and attached to the bottle 12 in the upright orientation.

Thus, a funnel cap device in accordance with the present invention may be conveniently attached to a sports bottle or other container having a shape similar to the frusto-conical portion of the funnel-shaped member. Because the frusto-conical portion preferably engages the neck of the bottle, the funnel cap device takes up substantially little or no additional space, as compared to a conventional bottle cap. When it is desired to introduce fluid into the bottle, the funnel cap member may be easily removed, inverted and attached to the spout. The funnel-shaped member thus provides a substantially wide opening into which fluid may be poured or otherwise introduced, which eliminates trying to pour into a narrow spout, and substantially reduces the waste and mess that may be associated with pouring into a narrow spout.

Figure 6:
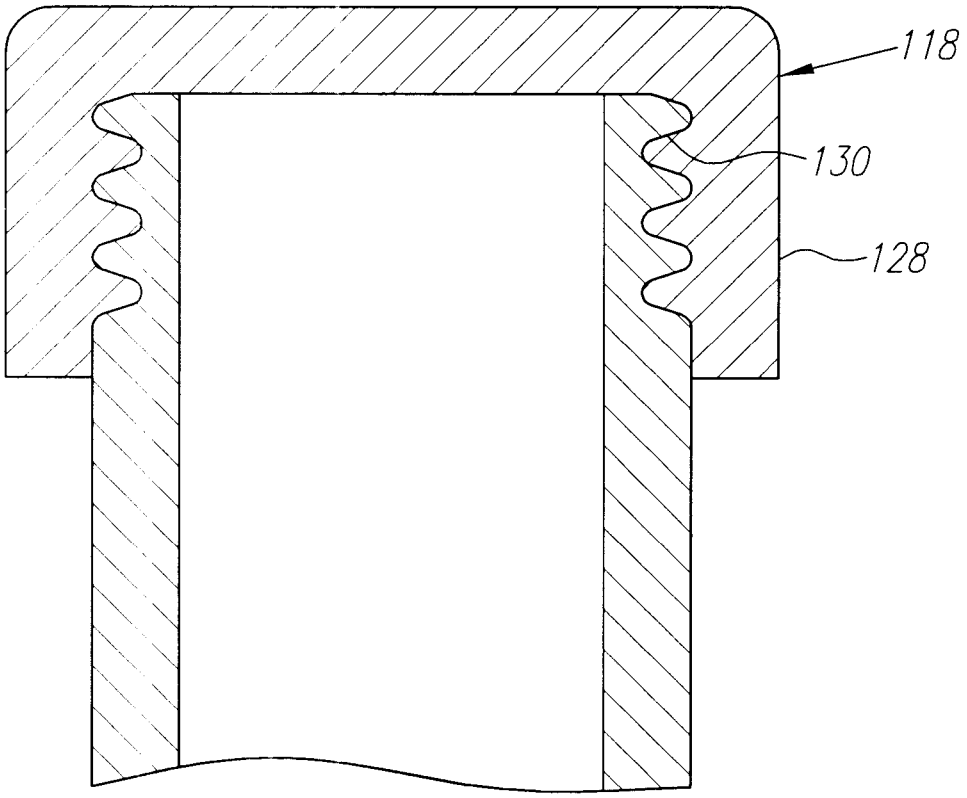
FIG. 6 is a cross-sectional view of an alternative embodiment of the hub portion the funnel-shaped member having a screw-on cap thereon.

In alternative embodiments, other closure or sealing mechanisms may be attached to the hub portion of the funnel-shaped member. For example, instead of the cap member and seal tab described above, a closed-end snap cap may be provided that is attachable to a lip on the hub portion (not shown). Alternatively, as shown in FIG. 6, a screw-on cap 118 may be provided along with similar threads 130 on the hub portion 128. To drink from the bottle, the snap cap or screw-on cap is removed from the hub portion, allowing fluid to be removed from the bottle. Prior to filling the bottle, the cap is removed from the hub portion, and then the funnel cap device is inverted and attached to the spout in its inverted orientation.

While the invention is susceptible to various modifications, and alternative forms, specific examples thereof have been shown in the drawings and are herein described in detail. It should be understood, however, that the invention is not to be limited to the particular forms or methods disclosed, but to the contrary, the invention is to cover all modifications, equivalents and alternatives falling within the spirit and scope of the appended claims.

What is claimed is:

1. A funnel cap device for a fluid container, comprising:

a generally funnel-shaped member having a passage therethrough extending between a wide end and a narrow end thereof; and a cap member attached to the funnel-shaped member and being slidable axially thereon for selectively opening and closing the narrow end of the passage;

wherein the narrow end has a thread pattern on an inner surface thereof for attaching the funnel cap device to a spout of a fluid container.

2. The funnel cap device of claim 1, wherein the funnel-shaped member has a shape similar to a neck of a fluid container to which the funnel cap device is attached.

3. The funnel cap device of claim 1, further comprising a hub portion extending from the narrow end of the funnel-shaped member, the cap member being slidable on the hub portion between open and closed positions, whereby fluid may pass through the passage in the open position.

4. The funnel cap device of claim 3, wherein the cap member includes an aperture and the hub portion includes a seal tab, the aperture being substantially engaged by the seal tab in the closed position for preventing fluid from passing through the passage.

5. The funnel cap device of claim 3, wherein the hub portion has a configuration for coupling the hub portion within a spout of a fluid container to facilitate filling of the fluid container.

6. The funnel cap device of claim 5, wherein the hub portion comprises a plurality of ribs extending radially outward therefrom for engaging an inner surface of the spout.

7. A funnel cap device for a fluid container, comprising:

a generally funnel-shaped member having a passage therethrough extending between a wide end and a narrow end thereof;

a cap member attached to the funnel-shaped member for selectively opening and closing the narrow end of the passage;

a hub portion extending from the narrow end of the funnel-shaped member, the cap member being slidable on the hub portion between open and closed positions, whereby fluid may pass through the passage in the open position;

the cap member and hub portion including a cooperating track and tab for limiting movement of the cap member between the open and closed positions; and a ridge in the track for preventing the cap member from inadvertently moving from the open or closed positions.

8. A funnel cap device for a fluid container, comprising:

a generally frusto-conical portion having a passage extending axially therethrough between a wide end and a narrow end thereof;

a hollow hub portion extending axially from the narrow end of the frusto-conical portion;

a cap attached to the hub portion, the cap being directable between open and closed positions to selectively seal the passage while remaining attached to the hub portion; and an intermediate portion between the frusto-conical portion and the hub portion, the intermediate portion having a thread pattern on an inner surface thereof for attaching the funnel cap device to a spout of a fluid container.

9. The funnel cap device of claim 8, wherein the frusto-conical portion has a shape similar to a neck of a fluid container to which the funnel cap device is attached.

10. The funnel cap device of claim 8, wherein the hub portion has a configuration for coupling the hub portion within a spout of a fluid container to facilitate filling of the fluid container.

11. The funnel cap device of claim 8, wherein the hub portion comprises a plurality of ribs extending radially outward therefrom for engaging an inner surface of a spout of a fluid container.

12. The funnel cap device of claim 8, wherein the cap includes an aperture and the hub portion includes a seal tab, the aperture being substantially engaged by the seal tab in the closed position for preventing fluid from passing through the passage.

13. A fluid container, comprising:

a container having a spout on one end thereof;

a generally funnel-shaped member having a passage extending therethrough between a wide end and a narrow end thereof, the narrow end having an outer end insertable into the spout; and a closable sealing mechanism engageable on the outer end of the narrow end of the funnel-shaped member;

wherein the narrow end includes a plurality of ribs affixed thereto and extending radially outward therefrom for engaging an inner surface of the spout, thereby providing passages between the narrow end and the inner surface of the spout, the ribs defining a diameter corresponding substantially to the interior of the spout to substantially secure the funnel-shaped member to the spout.

14. The fluid container of claim 13, wherein the funnel-shaped member comprises a hub portion extending from the narrow end thereof.

15. The fluid container of claim 13, wherein the sealing mechanism comprises an annular shaped cap member slidable on the hub portion between open and closed positions.

16. The fluid container of claim 13, wherein the ribs comprise notches for preventing a fluid-tight seal from being formed between the spout and the narrow end of the funnel-shaped member when the funnel-shaped member is fully inserted into the spout.

17. A fluid container, comprising:

a container having a spout on one end thereof;

a generally funnel-shaped member having a passage extending therethrough between a wide end and a narrow end thereof, the narrow end being insertable into the spout; and a closable sealing mechanism on the narrow end of the funnel-shaped member;

wherein the spout and an inner surface of the narrow end of the funnel-shaped member have cooperating thread patterns; and wherein the narrow end includes a plurality of ribs extending radially outward therefrom for engaging an inner surface of the spout, thereby providing passages between the narrow end and the inner surface of the spout.

18. A fluid container, comprising:

a container having a spout on one end thereof;

a generally funnel-shaped member having a passage extending therethrough between a wide end and a narrow end thereof, the narrow end being insertable into the spout; and a closable sealing mechanism on the narrow end of the funnel-shaped member;

wherein the closable sealing mechanism comprises a screw-on cap attachable to the narrow end of the funnel-shaped member; and wherein the narrow end includes a plurality of ribs extending radially outward therefrom for engaging an inner surface of the spout, thereby providing passages between the narrow end and the inner surface of the spout.

* * * * *